US006597273B2

(12) United States Patent
Takeda

(10) Patent No.: US 6,597,273 B2
(45) Date of Patent: Jul. 22, 2003

(54) THERMAL PROTECTOR

(75) Inventor: Hideaki Takeda, Misato (JP)

(73) Assignee: Uchiya Thermostat Co., Ltd., Saitama-ken (JP)

( * ) Notice: Subject to any disclaimer, the term of this patent is extended or adjusted under 35 U.S.C. 154(b) by 15 days.

(21) Appl. No.: 09/874,329

(22) Filed: Jun. 6, 2001

(65) Prior Publication Data

US 2002/0003465 A1 Jan. 10, 2002

(30) Foreign Application Priority Data

Jun. 6, 2000 (JP) ..... 2000-168447

(51) Int. Cl.[7] ..... H01H 37/04

(52) U.S. Cl. ..... 337/327; 337/298; 337/333; 337/342

(58) Field of Search ..... 337/298, 327, 337/329, 333, 342, 343, 380

(56) References Cited

U.S. PATENT DOCUMENTS

| | | | | |
|---|---|---|---|---|
| 3,818,410 A | | 6/1974 | Hire | |
| 3,936,788 A | * | 2/1976 | Uchiya | 337/372 |
| 5,699,899 A | | 12/1997 | Kahlbau | |
| 5,796,327 A | * | 8/1998 | Smith | 337/342 |
| 5,867,084 A | * | 2/1999 | Hofsass | 337/349 |
| 6,064,295 A | * | 5/2000 | Becher et al. | 337/349 |
| 6,265,961 B1 | | 7/2001 | Takeda | |

FOREIGN PATENT DOCUMENTS

| | | |
|---|---|---|
| DE | 84 11 724.9 U1 | 4/1986 |
| DE | 43 30 917 C1 | 2/1995 |

* cited by examiner

*Primary Examiner*—Jayprakash N. Gandhi
(74) *Attorney, Agent, or Firm*—Birch, Stewart, Kolasch & Birch, LLP

(57) ABSTRACT

A thermal projector includes a switching mechanism section having a fixed contact, a movable contact disposed so as to face the fixed contact. There are first and second external connection terminals projecting sideward and connected electrically to the fixed contact and movable contact, respectively. The switching mechanism section is constructed so that the movable contact is displaced by a deforming operation of a thermally-actuated element so as to be separated from and brought into contact with the fixed contact. A resin bottomed case having a peripheral wall is located around the switching mechanism section in a manner so that the first and second external connection terminals penetrate the peripheral wall, and the penetrating portions are adhesively sealed by molding the peripheral wall integrally with the connection terminals. There is a film formed member of an electric insulating material. The cover member is adhesively fixed to the upper end face of the peripheral wall of the case so as to seal the upper opening of the case.

18 Claims, 6 Drawing Sheets

THERMAL PROTECTOR

FIELD OF THE INVENTION AND RELATED ART STATEMENT

The present invention relates to a thermal protector used to prevent danger such as fire caused by an excessive rise in temperature of electrical equipment.

For the thermal protector of this type, water or the like sometimes intrudes into a switching mechanism section thereof depending on the operating environment of equipment to which the thermal protector is applied. Also, when the thermal protector of this type is incorporated in a small-size battery pack, electrolyte leaking from a secondary battery in the battery pack sometimes intrudes into the switching mechanism section. Further, when insulating vanish is used in an assembling process for equipment to which the thermal protector is applied, the insulating vanish sometimes intrude into the switching mechanism section.

The aforementioned entrance of water, electrolyte, vanish, and the like into the switch mechanism section may impair the function of the switching mechanism section. Furthermore, for a lithium ion battery in which the secondary battery of the battery pack uses flammable electrolyte, leaking electrolyte may be ignited by an arc generated at a contact of the switch mechanism.

Therefore, for the thermal protector used for a battery pack or the like, hermetically sealing ability is secured by taking some measures. For example, the switch mechanism section is inserted in a case of a bottomed cylindrical shape, and the opening of the case is sealed by a resin or rubber packing, or an opening between a part prepared by hermetic seal and a metallic case of a bottomed cylindrical shape is welded over the whole circumference.

However, any of the aforementioned measures requires much time and labor in fabrication. Specifically, the measure in which the opening of the case is sealed by a resin requires heating treatment for curing the resin because a liquid resin is used. Also, the measure in which the opening is sealed with a packing requires much time and labor to mount packings one by one. Further, the measure in which hermetic seal is used requires an inspection process for checking the hermetically sealing ability after the welding work over the whole circumference of opening is completed.

Also, any of the aforementioned measures has a problem in that it is difficult to make the whole shape of thermal protector small and thin by using a thin case because the case must have strength.

A method has been used as a trial in which a switch mechanism section is contained in a bottomed case in such a manner that external connection terminals are exposed to the outside, and after a cover is put on the upper opening of the case, the cover is welded to the upper face of the case by ultrasonic welding. However, if the thickness of the cover is decreased to provide a thin shape, the cover cannot withstand vibration energy needed for the ultrasonic welding, and therefore may be damaged.

OBJECT AND SUMMARY OF THE INVENTION

The present invention has been made in view of the above situation, and accordingly an object thereof is to provide a thermal protector that can provide high hermetically sealing ability with a simple and low-cost construction and also can be of a small and thin shape.

The thermal protector in accordance with the present invention comprises a switching mechanism section having a fixed contact, a movable contact disposed so as to face the fixed contact, and first and second external connection terminals projecting sideward and connected electrically to the fixed contact and movable contact, respectively, the switching mechanism section being constructed so that the movable contact is displaced by a deforming operation of a thermally-actuated element so as to be separated from and brought into contact with the fixed contact; a resin made bottomed case having a peripheral wall located around the switching mechanism section in such a manner that the first and second external connection terminals penetrate the peripheral wall, in which the penetrating portions of the external connection terminals are adhesively sealed by molding the peripheral wall integrally with the connection terminals; and a film-form cover member formed of an electric insulating material, the cover member being adhesively fixed to the upper end face of the peripheral wall of the case so as to seal the upper opening of the case.

According to the present invention, there can be provided a thermal protector that can keep the switching mechanism section in a hermetically sealed state with a simple and low-cost construction.

Also, since a film-form cover member thinner than resin molded products, among the electric insulators certified in the safety standard, is used to seal the opening of the case, the thermal protector can be constructed so as to have a small and thin shape.

Further, since sufficient hermetically sealing ability is insured, the thermal protector can suitably used for a secondary battery pack that has a possibility of leaking electrolyte.

The end face of the peripheral wall of the case is preferably formed so as to be flush to increase the sealing ability of the cover member and further decrease the thickness of the thermal protector.

The outside surface of the cover member is preferably covered with a reinforcing cover plate formed of a thin metallic sheet to increase the mechanical strength for coping with external force. In this case, since the inside surface of the reinforcing cover plate is covered by the cover member, the reinforcing cover plate need not be insulated electrically by an insulating tape or insulating tube.

The switching mechanism section can include a movable plate that is provided with the movable contact at one end portion thereof and is electrically connected to the second external connection terminal at the other end portion thereof. If the thermally-actuated element performs a deforming operation, one end portion of the movable plate is displaced upward, so that the movable contact separates from the fixed contact.

In the switching mechanism section, the movable contact can be provided at one end portion of the thermally-actuated element, and the other end portion of the thermally-actuated element can be electrically connected to the second external connection terminal. If the thermally-actuated element performs a deforming operation, the movable contact is displaced upward, so that the movable contact separates from the fixed contact.

In the case where the switching mechanism section includes the movable plate, the relative positional relationship between the cover member and the switching mechanism section can be set so that when the thermally-actuated element is deformed excessively by abnormal heat generation at the fixed contact and movable contact due to unstable contact or by abnormal heat generation in the movable plate due to an abnormal excessive current, the front end portion of the movable plate comes into contact with the inside surface of the cover member. In this case, the cover member is formed of a resin capable of being melted by the heat at the front end potion of the movable plate being in contact with the inside surface.

According to this construction, if heat is generated abnormally at the fixed contact and movable contact by unstable contact or if heat is generated abnormally in the movable plate by an abnormal excessive current, there can be provided a safety function of maintaining the opened state of the contacts of the switching mechanism section by utilizing the thermally melting properties and adhering properties of the cover member.

In the case where the movable contact is provided on the thermally-actuated element, the relative positional relationship between the cover member and the switching mechanism section can be set so that when the thermally-actuated element is deformed excessively by abnormal heat generation at the fixed contact and movable contact due to unstable contact or by abnormal heat generation in the thermally-actuated element due to an abnormal excessive current, the front end portion of the thermally-actuated element comes into contact with the inside surface of the cover member sealing the upper opening of the case. In this case, the cover member is formed of a resin capable of being melted by the heat at the front end potion of the thermally-actuated element being in contact with the inside surface.

According to this construction, if heat is generated abnormally at the fixed contact and movable contact by unstable contact or if heat is generated abnormally in the thermally-actuated element by an abnormal excessive current, there can be provided a safety function of maintaining the opened state of the contacts of the switching mechanism section by utilizing the thermally melting properties and adhering properties of the cover member.

As the thermally-actuated element, a bimetallic element that performs reversing operation at a predetermined temperature can be used.

Also, as the thermally-actuated element, a shape memory alloy that performs reversing operation at a predetermined temperature can be used.

The cover member can be constructed so that one surface of a film consisting of a thermosetting resin or paper is coated with a thermoplastic resin. The cover member is adhesively fixed to the case by melting the thermoplastic resin with heat.

The cover member can be constructed so that a film consisting of a thermoplastic resin is laminated on one surface of a film consisting of a thermosetting resin. The cover member is adhesively fixed to the case by melting the film consisting of a thermoplastic resin with heat.

The cover member can be constructed so that a film consisting of a thermoplastic resin is lapped over a film consisting of a thermosetting resin or heat resisting paper. The cover member is adhesively fixed to the case by melting the film consisting of a thermoplastic resin with heat.

The cover member can be constructed so that a plurality of films consisting of a thermoplastic resin having different melting points are laminated so that a film having the highest melting point is positioned on the outside. The cover member is adhesively fixed to the case by melting with heat the films except at least the film having the highest melting point.

The cover member can be formed of a heat-sealing film. The cover member is adhesively fixed to the case by heating the heat-sealing film.

The cover member can be formed of an adhesive tape formed by coating a film having heat resistance and electric insulating properties with an adhesive material. The cover member is fixed to the case by the adhesive force of the adhesive material.

The cover member can be formed of a film consisting of a resin having a melting point higher than the melting point of the material for the case and higher than the reversing operation temperature of the thermally-actuated element by a predetermined temperature or more. The cover member is adhesively fixed to the case by melting the end face of peripheral wall of the case with heat.

The thermal protector in accordance with another embodiment of the present invention comprises a switching mechanism section having a fixed contact, a movable contact disposed so as to face the fixed contact, and first and second external connection terminals projecting sideward and connected electrically to the fixed contact and movable contact, respectively, the switching mechanism section being constructed so that the movable contact is displaced by a deforming operation of a thermally-actuated element so as to be separated from and brought into contact with the fixed contact; a resin made bottomless case having a peripheral wall located around the switching mechanism section in such a manner that the first and second external connection terminals penetrate the peripheral wall, in which the penetrating portions of the external connection terminals are adhesively sealed by molding the peripheral wall integrally with the connection terminals; and film-form cover members formed of an electric insulating material, the cover members being adhesively fixed to the upper and lower end faces of the peripheral wall of the case so as to seal the upper and lower openings of the case, respectively.

This thermal protector can provide the same effect as that of the thermal protector having the bottomed case.

DETAILED DESCRIPTION OF PREFERRED EMBODIMENTS

Figure 1:
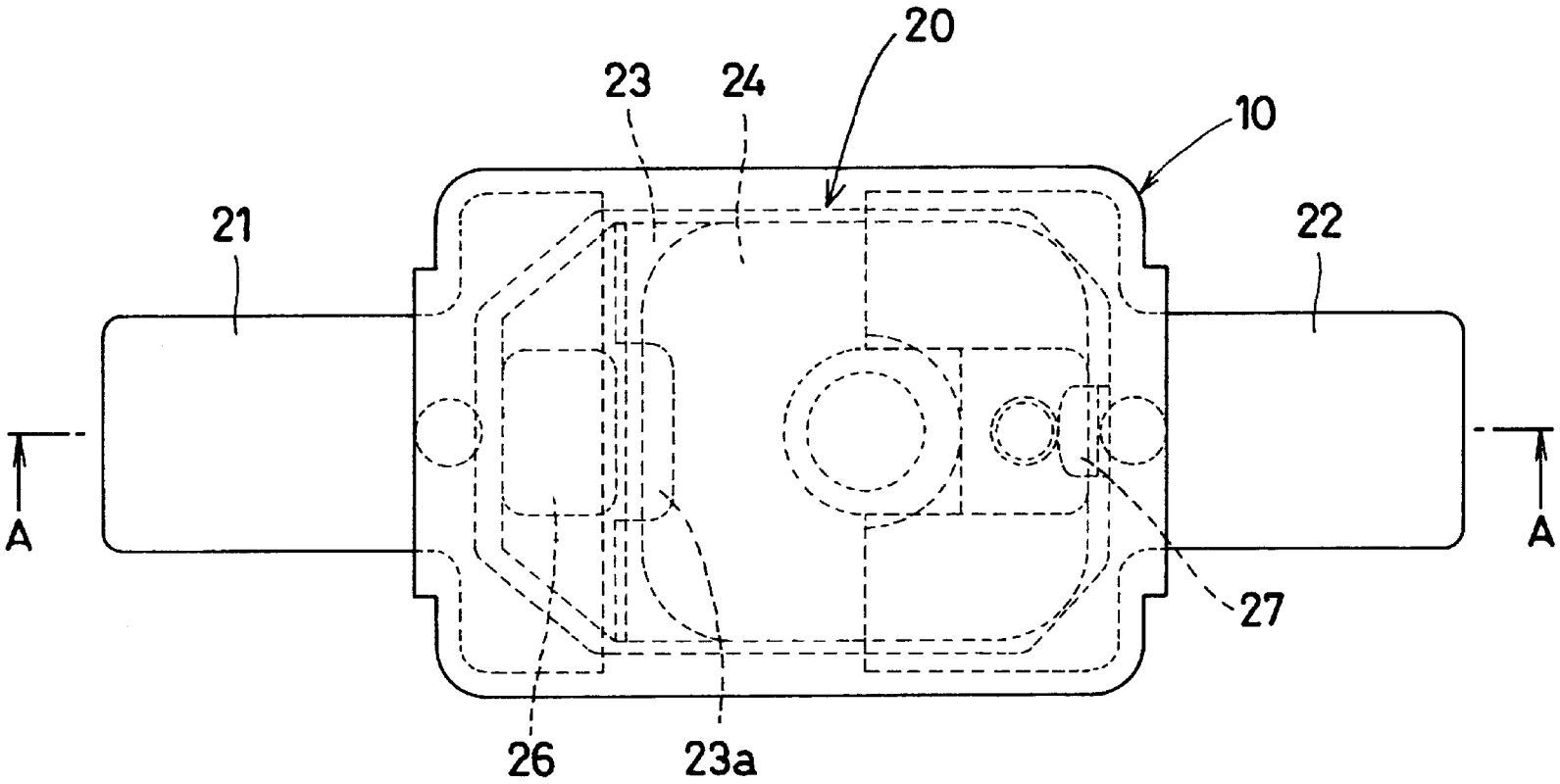
FIG. 1 is a plan view showing an embodiment of a thermal protector in accordance with the present invention.
Figure 2:
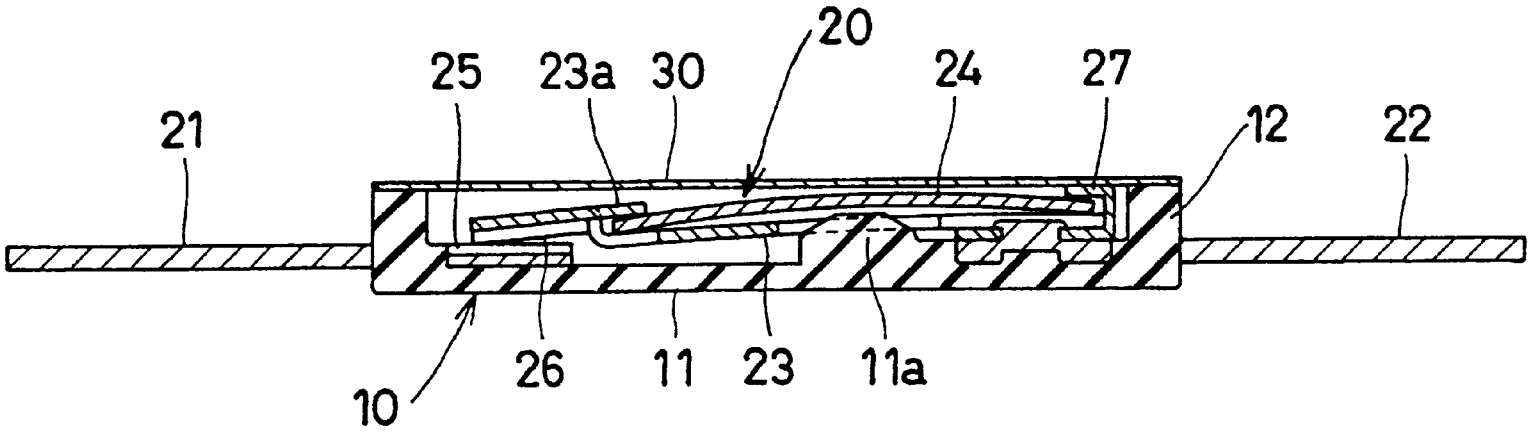
FIG. 2 is a sectional view taken along the line A—A of FIG. 1.
Figure 3:
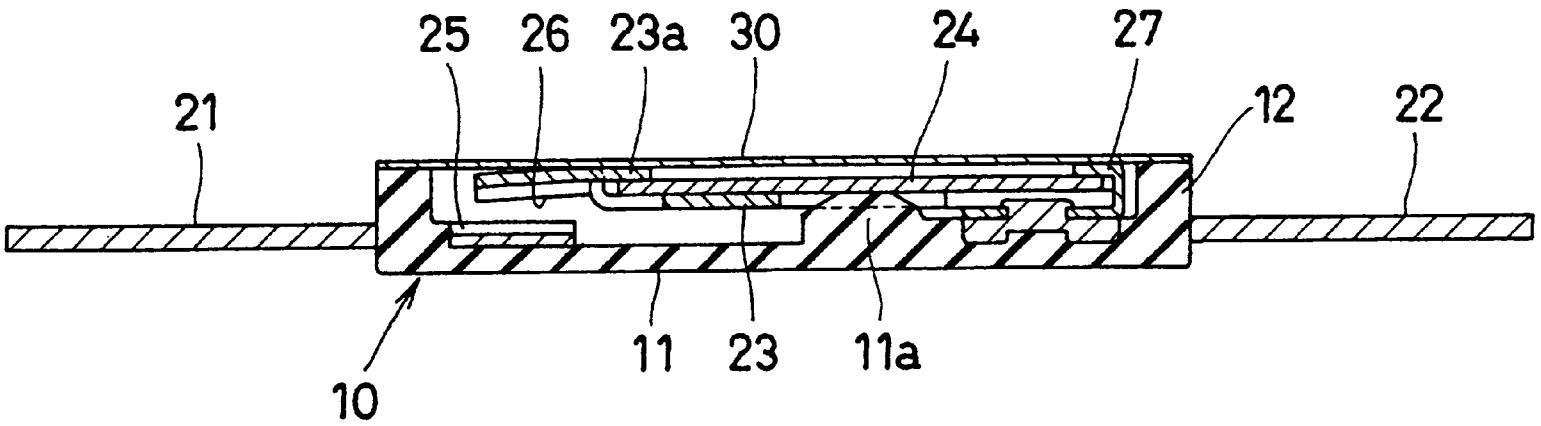
FIG. 3 is a sectional view showing a state in which contacts are opened.

FIG. 1 is a plan view of a thermal protector in accordance with the present invention, and FIG. 2 is a sectional view taken along the line A—A of FIG. 1. The thermal protector has a construction such that a switching mechanism section 20 is contained in a bottomed case 10, and the upper opening of the case 10 is sealed by a film-form cover member 30.

The case 10, which is made of a resin material, includes a bottom 11 and a peripheral wall 12 erected along the periphery of the bottom 11. As a resin material for forming the case 10, PPS (polyphenylene sulfide) or liquid crystal polymer, which has a relatively high melting point, or phenolic resin, unsaturated polyester resin, or the like, which is a thermosetting resin, is used.

The switching mechanism section 20 includes a pair of, right and left, external circuit connection terminals 21 and 22 penetrating the peripheral wall 12 of the case 10, and a movable plate 23 and a bimetallic element 24, which are disposed in the case 10.

The case 10 is molded integrally with the terminals 21 and 22 of the switching mechanism section 20. Therefore, the penetrating portions at which the terminals 21 and 22 penetrate the peripheral wall 12 are adhesively sealed by the resin forming the peripheral wall 12.

The base portions of the terminals 21 and 22 are located in the case 10, and a fixed contact 25 is formed on the upper face of the base portion of the terminal 21.

Figure 4:
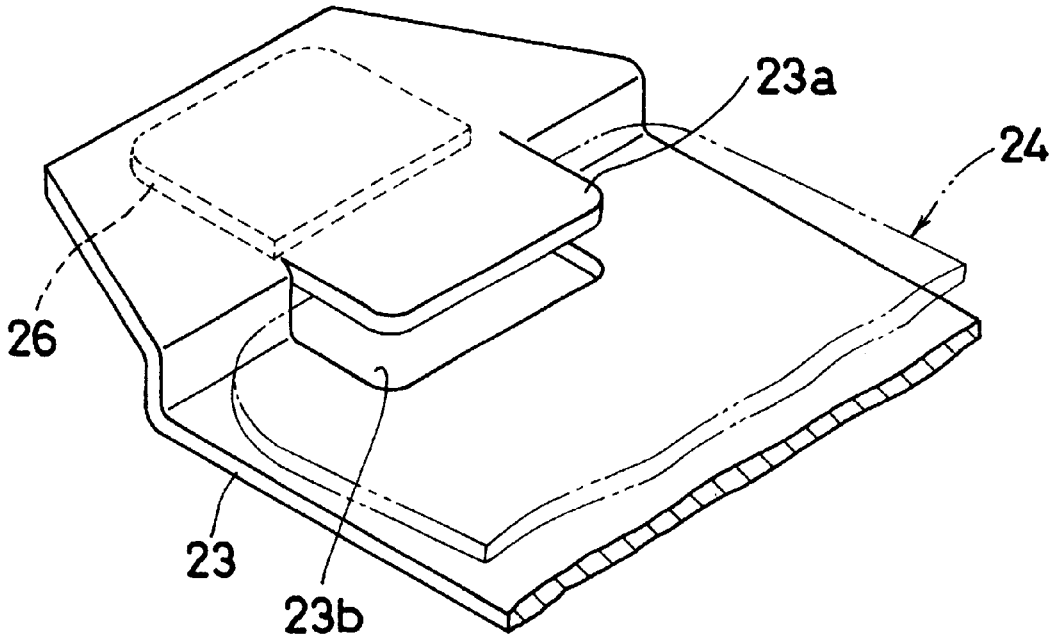
FIG. 4 is a perspective view showing a shape of front end portion of a movable plate.

The movable plate 23, which is formed of a metallic sheet having elasticity, is fitted with a movable contact 26 on the lower face of the front end portion thereof so as to face the fixed contact 25. As shown enlargedly in FIG. 4, the movable plate 23 is provided with a raised portion 23*a* projecting rearward at a portion near the rear end of the movable contact 26.

The raised portion 23*a* is formed by forming a cutting line along the contour of the raised portion 23*a* in the movable plate 23, and thereafter by bending both sides of the front end portion of the movable plate 23 into a step form.

The front end portion of the movable plate 23 is positioned higher than the rear portion thereof substantially by a thickness of the movable plate 23 by the above-described bending operation. Therefore, on the rear end side of the raised portion 23*a*, an opening (clearance) 23*b* open toward the rear of the movable plate 23 is formed.

The bimetallic element 24, which is a thermally-actuated element, is positioned on the upper face side of the movable plate 23. The front end portion of the bimetallic element 24 is inserted in the opening 23*b* formed in the movable plate 23, and the rear end thereof is loosely inserted in a holding member 27 having a U shape in cross section, which is crimped at the base end portion of the external connection terminal 22.

As shown in FIG. 1, the upper face of the front end portion of the bimetallic element 24 substantially coincides with the attachment face of the movable plate 23 onto which the movable contact 26 is attached.

At ordinary temperatures at which the bimetallic element 24 does not perform reversing operation, as shown in FIG. 2, the moveable contact 26 is pressed on and brought into contact with the fixed contact 25 by the elastic force of the movable plate 23. in this state, if the ambient temperature of the bimetallic element 24 reaches a predetermined reversing operation temperature due to heat generated abnormally in electrical equipment, not shown, connected to the terminals 21 and 22 or due to heat generated abnormally in the movable plate 23 etc. caused by an increase in the load current flowing across the terminals 21 and 22, the bimetallic element 24 performs reversing operation with a protrusion 11*a* projectingly provided at the bottom 11 of the case 10 serving as a fulcrum.

If the bimetallic element 24 performs reversing operation, the front end portion of the bimetallic element 24 raises the front end portion of the movable plate 23 via the raised portion 23*a* (see FIG. 4) of the movable plate 23. Therefore, the movable contact 26 is separated from the fixed contact 25 so that electrical connection between the terminals 21 and 22 is severed.

Since the switching mechanism section 20, which operates as described above, has a construction such that the upper face of the front end portion of the bimetallic element 24 engages with the raised portion 23*a*, the shape in the thickness direction can be shortened while a stable switching function is maintained.

The following is a description of the cover member 30. The cover member 30 is formed so as to have a thickness of, for example, about 0.1 mm, and is adhesively fixed to the upper face of the peripheral wall 12 of the case 10. Some examples of constructions and adhering methods for the cover member 30 will be described below.

(1) Construction Example 1

The cover member 30 of construction example 1 has a construction such that a film consisting of a thermosetting resin or paper having electric insulating properties is used as a base material, and one surface of the base material is coated with a thermoplastic resin, thereby forming a adhesive layer.

As the aforementioned thermosetting resin, polyimide resin or the like is used, and as the paper, heat resisting paper such as aramid paper is used. As the thermoplastic resin, polyamide, polyolefin, EVA, polyester, or the like is used.

This cover member 30 is disposed in such a manner that the adhesive layer abuts against the upper end face of the peripheral wall 12, and is adhesively fixed to the upper end face of the peripheral wall 12 by melting the adhesive layer with heat.

(2) Construction Example 2

The cover member 30 of construction example 2 has a construction such that a film consisting of a thermosetting resin or paper having electric insulating properties is used as a base material, and a film consisting of a thermoplastic resin is lapped over the base material as an adhesive material.

As the aforementioned thermosetting resin, paper, and thermoplastic resin, the materials described by way of example in item (1) are used.

This cover member 30 is disposed in such a manner that the adhesive material film consisting of a thermoplastic resin abuts against the upper end face of the peripheral wall 12, and is adhesively fixed to the upper end face of the peripheral wall 12 by melting the film with heat.

(3) Construction Example 3

The cover member 30 of construction example 3 has a construction such that a film consisting of a thermoplastic resin is laminated on one surface of a film consisting of a thermosetting resin.

As the aforementioned thermosetting resin, thermosetting polyimide resin is used, and as the thermoplastic resin, thermoplastic polyimide resin or FEP (tetrafluoroethylene hexafluoropropylene copolymer), which is a Teflon-family resin, or the like is used.

This cover member 30 is disposed on the upper face of the peripheral wall 12 in such a manner that the thermoplastic film faces downward, and is heated in this state. Since the thermoplastic film exhibits adhesive properties as the result of heating, the cover member 30 is fixed to the upper end face of the peripheral wall 12 of the case 10 by utilizing the adhesive properties.

(4) Construction Example 4

The cover member 30 of construction example 4 has a construction such that a plurality of films consisting of a thermoplastic resin having different melting points are laminated so that a film having the highest melting point is positioned on the outside.

This cover member 30 is disposed on the upper face of the peripheral wall 12 in such a manner that the film having the highest melting point is positioned at the top, and is adhesively fixed to the upper end face of the peripheral wall 12 by melting with heat the films except at least the film having the highest melting point.

(5) Construction Example 5

The cover member 30 of construction example 5 is formed of a heat-sealing film. As known well, the heat-sealing film is used when chip parts mounted on a substrate are subjected to taping treatment (treatment in which chip parts are contained in concaves formed at predetermined intervals in a carrier tape, and the carrier tape is adhered to a heat-sealing tape by heating).

This cover member 30 is disposed on the upper face of the peripheral wall 12 in such a manner that a adhesive layer is positioned at the bottom, and is adhesively fixed to the upper end face of the peripheral wall 12 by melting the adhesive layer with heat.

(6) Construction Example 6

The cover member 30 of construction example 6 has a construction such that one surface of a film consisting of a resin or paper having heat resistance and electric insulating properties is coated with an adhesive material.

As the resin constituting the aforementioned film, polyimide resin or the like is used, and as the paper constituting the film, heat resisting paper such as aramid paper is used.

This cover member 30 is adhesively fixed to the upper end face of the peripheral wall 12 of the case 10 by the adhesive force of the adhesive material.

(7) Construction Example 7

The cover member 30 of construction example 7 is formed of a film consisting of a resin having a melting point higher than the melting point of the material for the case 10 and higher than the reversing operation temperature of the thermally-actuated element by a predetermined temperature (for example, 50° C.) or more.

As the resin constituting the aforementioned film, polyester resin, PPS, polyimide, or the like can be used.

This cover member 30 is disposed on the upper face of the peripheral wall 12 of the case 10, and then is adhesively fixed to the upper end face by melting the upper end face with heat.

Since the upper opening of the case 10 is sealed by the film-form cover member 30 as described in items (1) to (7), the thermal protector constructed as described above can be formed into a thin shape. Moreover, since the penetrating portions at which the terminals 21 and 22 penetrate the peripheral wall 12 are adhesively sealed by the resin forming the peripheral wall 12, the switching mechanism section 20 except the exposed portions of the terminals 21 and 22 can be hermetically enclosed in an enclosed space defined by the case 10 and the cover member 30.

Figure 5:
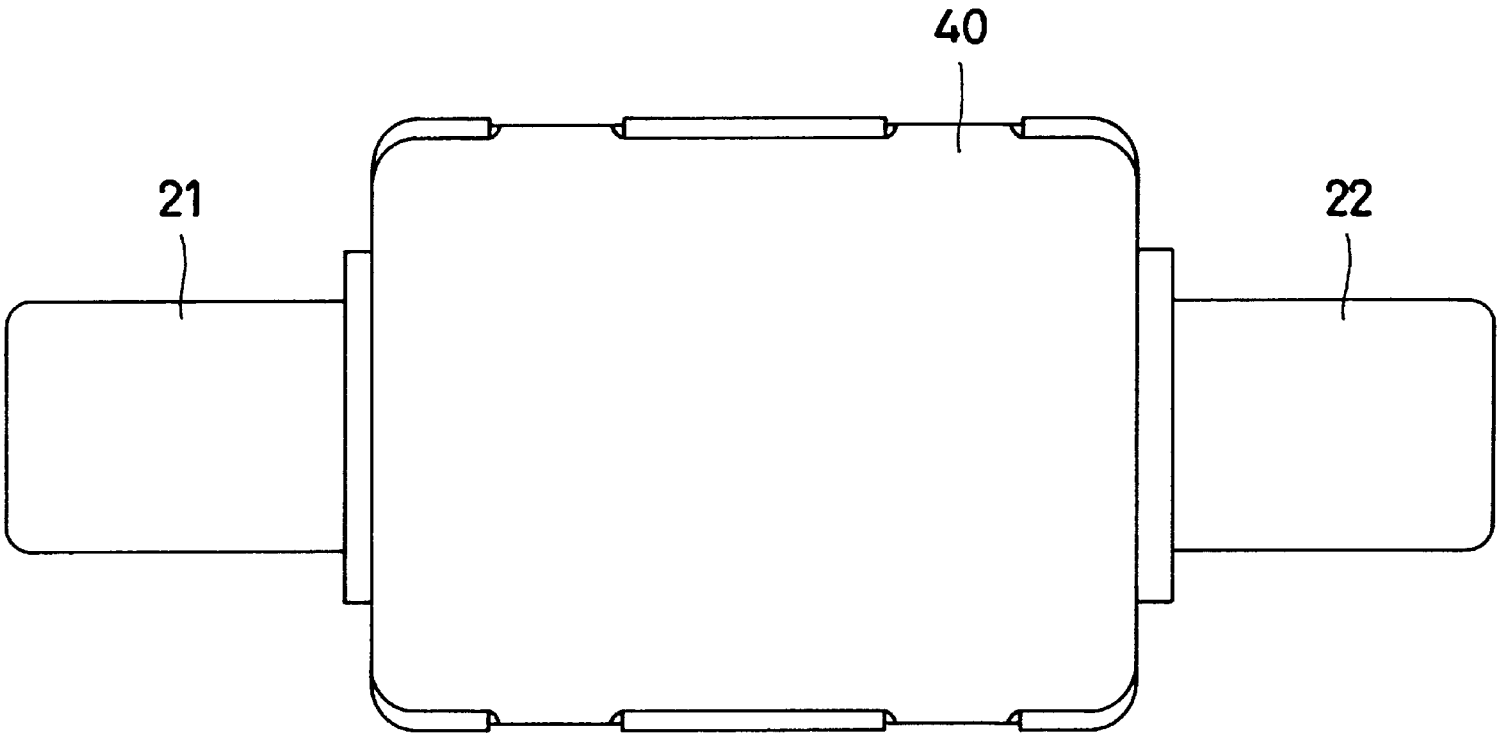
FIG. 5 is a plan view typically showing an attachment mode of a reinforcing cover plate.
Figure 6:
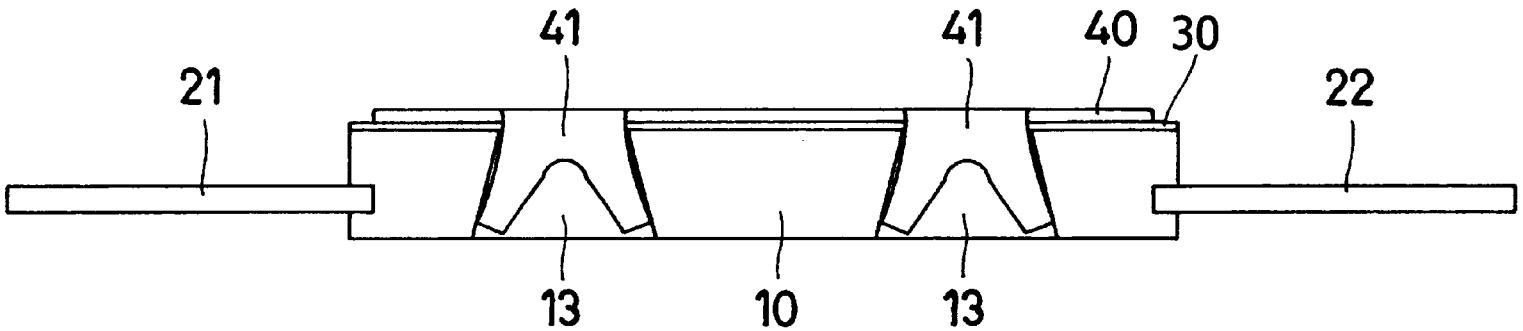
FIG. 6 is a side view typically showing an attachment mode of a reinforcing cover plate.

FIGS. 5 and 6 show an embodiment in which a reinforcing cover plate 40 consisting of a thin metallic sheet is disposed so as to be lapped over the outside surface of the cover member 30.

The reinforcing cover plate 40, which is formed of a stainless steel sheet with a thickness of, for example, about 0.1 mm, is fixed to the case 10 as described below. Specifically, the cover plate 40 is provided with a pair of locking tongues 41 bent substantially through 90 degrees with respect to the top surface of the cover plate 40 at both end portions thereof, and the locking tongues 41 are elastically fitted in grooves 13 formed in the side faces of the case 10, by which the cover plate 40 is fixed to the case 10.

The tongue 41 is provided with bifurcated tip end portions, and the tip end portions are contactingly engaged with tapered side faces of the groove 13. Therefore, the state in which the reinforcing cover plate 40 is in contact with the top surface of the cover member 30 is maintained stably.

When the reinforcing cover plate 40 is provided, the thickness of the cover member 30 can be made smaller than 0.1 mm. For example, the thickness thereof can be decreased to about 15 to 50 $\mu$m.

The construction of the switching mechanism section 20 is not limited to the construction shown in FIG. 2. For example, the switching mechanism section 20 may be constructed so that the bimetallic element is provided under the movable plate 23, and the movable contact 26 is separated from the fixed contact 25 by pushing up the front end portion of the movable plate 23 by the reversing force of the bimetallic element.

Also, the switching mechanism section 20 may be constructed so that the movable contact 26 is provided at the front end portion of the bimetallic element 24 so that the contacts 25 and 26 are opened and closed directly by the reversing operation of the bimetallic element 24. In this case, needless to say, the movable plate 23 is omitted, and also the base portion of the bimetallic element 24 is electrically connected to the terminal 22.

Further, a shape memory alloy can be used in place of the bimetallic element 24. When a one-way shape memory alloy is used, this shape memory alloy is combined with the movable plate 23, so that the movable plate 23 is displaced by the deformation force of the shape memory alloy, and the shape memory alloy is returned by the elastic reaction force of the movable plate 23.

As a matter of course, configuration can be such that the movable contact 26 is provided on the one-way shape memory alloy, and the contacts 25 and 26 are opened and closed directly by the deforming operation of the shape memory alloy. The switching mechanism section configured as described above provides a function of one-shot type thermal protector because the shape memory alloy once deformed keeps its deformed state.

On the other hand, when a two-way shape memory alloy is used, the movable plate 23 is omitted. Specifically, the movable contact 26 is provided on the shape memory alloy, and the contacts 25 and 26 are opened and closed by the deforming operation of the shape memory alloy.

In this case, one end and the other end of the shape memory alloy can be short-circuited by a bypassing good conductor with flexibility to reduce internal resistance of the shape memory alloy.

Although the thermal protectors shown in FIGS. 2 and 6 use a bottomed case 10, a bottomless case, not shown, can be used in place of the case 10.

In this case, a cover member that is similar to the cover member 30 is adhered to the lower end face of the peripheral wall 12 shown in FIG. 2 to seal the lower opening of the bottomless case. As necessary, a reinforcing cover plate that is similar to the reinforcing cover plate 40 shown in FIG. 6 is disposed so as to be lapped over the outside surface of the cover member.

For the above-described thermal protector, the contacts 25 and 26 are worn out gradually by the repeated protecting operations caused by abnormality of electrical equipment to which the thermal protector is applied. If the wear proceeds to a given degree, the contacting state of the contacts 25 and 26 becomes unstable, and the contacts 25 and 26 generate heat abnormally. In the worst case, the contacts 25 and 26 may sometimes melt and adhere to each other.

At the stage before the contacts 25 and 26 melt and adhere to each other, the contacts 25 and 26 are in a state of generating heat considerably. Considering a case where the bimetallic element 24 performs reversing operation in this state so that the contacts 25 and 26 are opened, the ambient temperature of the bimetallic element 24 is higher than the reversing operation temperature (overshoot) due to the influence of heat generation at the contacts 25 an 26, the bimetallic element 24 warps on a smaller radius of curvature than the ordinary one.

If the bimetallic element 24 warps excessively in this manner, the front end portion of the movable plate 23 is raised higher than usual (pushed up depending on the construction of the switching mechanism), so that the rise height of the movable contact 26 increases.

For the thermal protector in accordance with the present invention, the height at which the cover member 30 is disposed is set so that the upper face of front end portion of the movable plate 23 is pressed on the inside surface of the cover member 30 if the bimetallic element 24 warps excessively as described above.

Therefore, if the bimetallic element 24 warps excessively, the front end portion of the movable plate 23 heated to a high temperature by the heat generated at the contact 26 comes into contact with the inside surface of the cover member 30 and melts the inside surface, and thereafter is adhered to the inside surface of the cover member 30 by the subsequent cooling.

That is to say, if the bimetallic element 24 performs reversing operation while heat is generated abnormally at the contacts 25 and 26 by unstable contact, the thermal protector in accordance with the present invention ceases its function, and operates so as to maintain the opened state of the contacts 25 and 26. Therefore, an accident can be avoided in which the contacts 25 and 26 melt and adhere to each other, and thereby the energized state of electrical equipment to which the thermal protector is applied is continued.

Needless to say, in order to provide such a function, it is necessary to select a resin material having a lower melting point than the temperature of the heated front end portion of the movable plate 23 as the resin material forming the inside surface of the cover member 30.

The above-described excessive warping operation of the bimetallic element 24 also occurs by a cause other than the abnormal heat generation at the contacts 25 and 26. For example, if an excessive abnormal load current flows in the movable plate 23, the heat generated in the movable plate 23 becomes abnormally high, so that the bimetallic element 24 warps excessively.

In this case as well, the front end portion of the movable plate 23 in which heat is generated is adhered to the inside surface of the cover member 30, so that the opened state of the contacts 25 and 26 is maintained. Therefore, wear of a load caused by the above-described excessive abnormal load current can be prevented.

The above-described safety function can be provided as a matter of course in the case where a switching mechanism section of a type such that the movable contact 26 is provided at the front end portion of the bimetallic element 24 is used, or in the case where a switching mechanism section of a type such that a shape memory alloy is used in place of the bimetallic element 24 is used.

What is claimed is:

1. A thermal protector comprising:

a switching mechanism section having a fixed contact, a movable contact disposed so as to face said fixed contact, and first and second external connection terminals projecting sideward and connected electrically to said fixed contact and movable contact, respectively, said switching mechanism section being constructed so that said movable contact is displaced by a deforming operation of a thermally-actuated element so as to be separated from and brought into contact with said fixed contact;

a resin made bottomed case having a peripheral wall located around said switching mechanism section in such a manner that said first and second external connection terminals penetrate said peripheral wall, in which the penetrating portions of said external connection terminals are adhesively sealed by molding said peripheral wall integrally with said connection terminals;

a film-form cover member formed of an electric insulating material, said cover member being adhesively fixed to the upper end face of the peripheral wall of said case so as to seal the upper opening of said case;

the end face of the peripheral wall of said case is formed so as to be flush;

the outside surface of said cover member is covered with a reinforcing cover plate formed of a thin metallic sheet to increase the mechanical strength of said cover member;

said switching mechanism section includes a movable plate provided with said movable contact at one end portion thereof and electrically connected to said second external connection terminal at the other end portion thereof so that one end portion of said movable plate is displaced upward by a deforming operation of said thermally-actuated element to separate said movable contact from said fixed contact;

wherein the relative positional relationship between said cover member and said switching mechanism section is set so that when said thermally-actuated element is deformed excessively by abnormal heat generation at said fixed contact and movable contact due to unstable contact or by abnormal heat generation in said movable plate due to an abnormal excessive current, the front end portion of said movable plate comes into contact with the inside surface of said cover member sealing the upper opening of said case, and the inside surface of said cover member is formed of a resin capable of being melted by the heat at the front end potion of said movable plate being in contact with said inside surface.

2. The thermal protector according to claim 1, wherein as said thermally-actuated element, a bimetallic element performing reversing operation at a predetermined temperature is used.

3. The thermal protector according to claim 1, wherein as said thermally-actuated element, a shape memory alloy performing reversing operation at a predetermined temperature is used.

4. The thermal protector according to claim 1, wherein said cover member has a construction such that one surface of a film consisting of a thermosetting resin or paper is coated with a thermoplastic resin, and said cover member is adhesively fixed to said case by melting said thermoplastic resin with heat.

5. The thermal protector according to claim 1,wherein said cover member has a construction such that a film consisting of a thermoplastic resin is laminated on one surface of a film consisting of a thermosetting resin, and said cover member is adhesively fixed to said case by melting said film consisting of a thermoplastic resin with heat.

6. The thermal protector according to claim 1, wherein said cover member has a construction such that a film consisting of a thermoplastic resin is lapped over a film consisting of a thermosetting resin or heat resisting paper, and said cover member is adhesively fixed to said case by melting said film consisting of a thermoplastic resin with heat.

7. The thermal protector according to claim 1, wherein said cover member has a construction such that a plurality of films consisting of a thermoplastic resin having different melting points are laminated so that a film having the highest melting point is positioned on the outside, and said cover member is adhesively fixed to said case by melting with heat the films except at least the film having the highest melting point.

8. The thermal protector according to claim 1, wherein said cover member is formed of a heat-sealing film, and said cover member is adhesively fixed to said case by heating said heat-sealing film.

9. The thermal protector according to claim 1, wherein said cover member is formed of a film consisting of a resin having a melting point higher than the melting point of the material for said case and higher than the reversing operation temperature of said thermally-actuated element by a predetermined temperature or more, and said cover member is adhesively fixed to said case by melting the end face of peripheral wall of said case with heat.

10. A thermal protector comprising:

a switching mechanism section having a fixed contact, a movable contact disposed so as to face said fixed contact, and first and second external connection terminals projecting sideward and connected electrically to said fixed contact and movable contact, respectively, said switching mechanism section being constructed so that said movable contact is displaced by a deforming operation of a thermally-actuated element so as to be separated from and brought into contact with said fixed contact;

a resin made bottomed case having a peripheral wall located around said switching mechanism section in such a manner that said first and second external connection terminals penetrate said peripheral wall, in which the penetrating portions of said external connection terminals are adhesively sealed by molding said peripheral wall integrally with said connection terminals;

a film-form cover member formed of an electric insulating material, said cover member being adhesively fixed to the upper end face of the peripheral wall of said case so as to seal the upper opening of said case;

peripheral wall of said case is formed so as to be flush;

the outside surface of said cover member is covered with a reinforcing cover plate formed of a thin metallic sheet to increase the mechanical strength of said cover member;

said switching mechanism section is configured so that said movable contact is provided at one end portion of said thermally-actuated element, and the other end portion of said thermally-actuated element is electrically connected to said second external connection terminal, so that said movable contact is displaced upward by a deforming operation of said thermally-actuated element to separate said movable contact from said fixed contact.

wherein the relative positional relationship between said cover member and said switching mechanism section is set so that when said thermally-actuated element is deformed excessively by abnormal heat generation at said fixed contact and movable contact due to unstable contact or by abnormal heat generation in said thermally-actuated element due to an abnormal excessive current, the front end portion of said thermally-actuated element comes into contact with the inside surface of said cover member sealing the upper opening of said case, and the inside surface of said cover member is formed of a resin capable of being melted by the heat at the front end potion of said thermally-actuated element being in contact with said inside surface.

11. The thermal protector according to claim 10, wherein as said thermally-actuated element, a bimetallic element performing reversing operation at a predetermined temperature is used.

12. The thermal protector according to claim 10, wherein as said thermally-actuated element, a shape memory alloy performing reversing operation at a predetermined temperature is used.

13. The thermal protector according to claim 10, wherein said cover member has a construction such that one surface of a film consisting of a thermosetting resin or paper is coated with a thermoplastic resin, and said cover member is adhesively fixed to said case by melting said thermoplastic resin with heat.

14. The thermal protector according to claim 10, wherein said cover member has a construction such that a film consisting of a thermoplastic resin is laminated on one surface of a film consisting of a thermosetting resin, and said cover member is adhesively fixed to said case by melting said film consisting of a thermoplastic resin with heat.

15. The thermal protector according to claim 10, wherein said cover member has a construction such that a film consisting of a thermoplastic resin is lapped over a film consisting of a thermosetting resin or heat resisting paper, and said cover member is adhesively fixed to said case by melting said film consisting of a thermoplastic resin with heat.

16. The thermal protector according to claim 10, wherein said cover member has a construction such that a plurality of films consisting of a thermoplastic resin having different melting points are laminated so that a film having the highest melting point is positioned on the outside, and said cover member is adhesively fixed to said case by melting with heat the films except at least the film having the highest melting point.

17. The thermal protector according to claim 10, wherein said cover member is formed of a heat-sealing film, and said cover member is adhesively fixed to said case by heating said heat-sealing film.

18. The thermal protector according to claim 10, wherein said cover member is formed of a film consisting of a resin having a melting point higher than the melting point of the material for said case and higher than the reversing operation temperature of said thermally-actuated element by a predetermined temperature or more, and said cover member is adhesively fixed to said case by melting the end face of peripheral wall of said case with heat.

* * * * *